US008341853B2

(12) United States Patent
French et al.

(10) Patent No.: US 8,341,853 B2
(45) Date of Patent: Jan. 1, 2013

(54) DRYING APPARATUS

(75) Inventors: Timothy Alexander French, Malmesbury (GB); Peter Nigel Hutchinson, Malmesbury (GB); Frederic Nicolas, Malmesbury (GB)

(73) Assignee: Dyson Technology Limited, Malmesbury (GB)

( * ) Notice: Subject to any disclaimer, the term of this patent is extended or adjusted under 35 U.S.C. 154(b) by 1086 days.

(21) Appl. No.: 11/997,309

(22) PCT Filed: Jun. 7, 2006

(86) PCT No.: PCT/GB2006/002084

§ 371 (c)(1),
(2), (4) Date: Jan. 29, 2008

(87) PCT Pub. No.: WO2007/015039

PCT Pub. Date: Feb. 8, 2007

(65) Prior Publication Data

US 2008/0209760 A1 Sep. 4, 2008

(30) Foreign Application Priority Data

Jul. 30, 2005 (GB) ..... 0515754.0

(51) Int. Cl.
*F26B 11/02* (2006.01)

(52) U.S. Cl. ..... 34/90; 34/105; 34/202; 34/218; 165/11.1; 454/313; 62/407; 15/300.1

(58) Field of Classification Search ..... 34/90, 105, 34/585, 595, 218, 202, 210, 242; 165/11.1, 165/178; 134/21; 15/300.1; 454/284, 313; 62/259.3, 407

See application file for complete search history.

(56) References Cited

U.S. PATENT DOCUMENTS

| | | | |
|---|---|---|---|
| 16,110 | A | 11/1856 | Baldwin |
| 1,258,633 | A | 3/1918 | Heath |
| 1,500,094 | A | 7/1924 | Kee |
| 1,598,660 | A | 9/1926 | Sieben |
| 1,658,489 | A | 2/1928 | Lindstrom |
| 1,688,793 | A | 10/1928 | Schrenkeisen |
| 1,693,308 | A | 11/1928 | Merkowitz |
| 1,704,136 | A | 3/1929 | Lemp |
| 1,830,323 | A | 11/1931 | Judelson et al. |

(Continued)

FOREIGN PATENT DOCUMENTS

AU 2005-203363 2/2006

(Continued)

OTHER PUBLICATIONS

International Search Report and written Opinion of the International Searching Authority dated Aug. 25, 2006, directed to counterpart application No. PCT/GB2006/002084. (15 pages).

(Continued)

*Primary Examiner* — Stephen M. Gravini
(74) *Attorney, Agent, or Firm* — Morrison & Foerster LLP

(57) ABSTRACT

A drying apparatus has a casing, a cavity formed in the casing for receiving an object, a fan located in the casing and creating an airflow, a motor provided in the casing for driving the fan and ducting for carrying the airflow from the fan to at least one opening arranged to emit the airflow into the cavity, wherein the ducting includes at least one air duct in which at least one vane is located, the vane extending in the direction of airflow and dividing the air duct into a plurality of airflow portions.

20 Claims, 6 Drawing Sheets

U.S. PATENT DOCUMENTS

| | | | | | |
|---|---|---|---|---|---|
| 1,961,179 | A | | 6/1934 | Tinkham | |
| 2,013,572 | A | | 9/1935 | McCord | |
| 2,104,135 | A | | 1/1938 | Morrill | |
| 2,109,028 | A | | 2/1938 | Miller | |
| 2,109,704 | A | | 3/1938 | Morrill | |
| 2,111,148 | A | | 3/1938 | Judelson | |
| 2,134,493 | A | | 10/1938 | Uroukoff | |
| 2,188,506 | A | * | 1/1940 | Hall | 426/471 |
| 2,260,558 | A | | 10/1941 | Caughey et al. | |
| 2,267,158 | A | | 12/1941 | Locke | |
| 2,278,574 | A | | 4/1942 | Spohr et al. | |
| 2,287,795 | A | * | 6/1942 | Hall | 159/4.2 |
| 2,385,962 | A | | 10/1945 | Barnett | |
| 2,438,762 | A | | 3/1948 | McLeckie | |
| 2,452,858 | A | * | 11/1948 | Miller | 264/605 |
| 2,479,387 | A | | 8/1949 | Matthews et al. | |
| 2,504,740 | A | | 4/1950 | Siegel | |
| 2,550,118 | A | | 4/1951 | Kauffman, II | |
| 2,645,032 | A | | 7/1953 | Hammell | |
| 2,761,222 | A | | 9/1956 | Bennett | |
| 2,859,535 | A | | 11/1958 | Carlson | |
| 2,911,732 | A | | 11/1959 | Webb | |
| 3,009,188 | A | | 11/1961 | Martin | |
| 3,071,801 | A | | 1/1963 | Scheiding | |
| 3,091,955 | A | | 6/1963 | Taylor et al. | |
| 3,096,702 | A | | 7/1963 | Malone, Sr. et al. | |
| 3,180,239 | A | | 4/1965 | Shearer et al. | |
| 3,233,339 | A | | 2/1966 | Long et al. | |
| 3,258,853 | A | | 7/1966 | Bradbury | |
| 3,305,938 | A | | 2/1967 | Arthur | |
| 3,312,160 | A | | 4/1967 | Rackley | |
| 3,321,844 | A | | 5/1967 | Seedorf | |
| 3,375,593 | A | | 4/1968 | Fleisher et al. | |
| 3,383,700 | A | | 5/1968 | Taylor | |
| 3,409,995 | A | | 11/1968 | Greenwood et al. | |
| 3,437,030 | A | | 4/1969 | Mastrosimone et al. | |
| 3,448,497 | A | | 6/1969 | Arnold et al. | |
| 3,464,388 | A | | 9/1969 | Stout | |
| 3,526,946 | A | | 9/1970 | Palmer | |
| 3,587,177 | A | | 6/1971 | Overly et al. | |
| 3,603,002 | A | | 9/1971 | Spierer | |
| 3,610,881 | A | | 10/1971 | Stewart | |
| 3,612,824 | A | | 10/1971 | Berryman | |
| 3,643,346 | A | | 2/1972 | Lester | |
| 3,667,134 | A | | 6/1972 | Rockson | |
| 3,670,718 | A | | 6/1972 | Brendgord | |
| 3,721,026 | A | | 3/1973 | McCallum | |
| 3,744,149 | A | | 7/1973 | Helbling | |
| 3,748,746 | A | | 7/1973 | Robandt | |
| 3,752,059 | A | | 8/1973 | Boyer | |
| 3,758,799 | A | | 9/1973 | Dochterman et al. | |
| 3,766,397 | A | | 10/1973 | Rockson | |
| 3,785,523 | A | | 1/1974 | Goldstein | |
| 3,797,752 | A | | 3/1974 | Cercone | |
| 3,814,898 | A | | 6/1974 | Levine | |
| 3,826,607 | A | | 7/1974 | Kuhn | |
| 3,854,219 | A | | 12/1974 | Staats | |
| 3,874,073 | A | | 4/1975 | Dochterman et al. | |
| 3,952,867 | A | | 4/1976 | McCord | |
| 4,015,366 | A | | 4/1977 | Hall, III | |
| 4,039,774 | A | | 8/1977 | Kata et al. | |
| 4,047,692 | A | | 9/1977 | Swin, Sr. | |
| 4,085,522 | A | | 4/1978 | Stroszynski | |
| 4,087,925 | A | | 5/1978 | Bienek | |
| 4,091,762 | A | | 5/1978 | Ruehl | |
| 4,107,257 | A | | 8/1978 | Swin, Sr. | |
| 4,144,596 | A | | 3/1979 | MacFarlane et al. | |
| 4,145,769 | A | | 3/1979 | MacFarlane et al. | |
| 4,188,732 | A | | 2/1980 | Quayle | |
| 4,195,419 | A | | 4/1980 | Quayle | |
| 4,205,460 | A | | 6/1980 | Taylor | |
| 4,220,846 | A | | 9/1980 | Rice et al. | |
| 4,250,631 | A | | 2/1981 | Moses | |
| 4,267,643 | A | | 5/1981 | Haried | |
| 4,278,223 | A | | 7/1981 | Fauteux | |
| 4,295,233 | A | | 10/1981 | Hinkel et al. | |
| 4,310,747 | A | | 1/1982 | Rice et al. | |
| 4,312,139 | A | | 1/1982 | Preisler et al. | |
| 4,313,787 | A | | 2/1982 | Ciboit et al. | |
| 4,334,350 | A | | 6/1982 | Rice et al. | |
| RE31,023 | E | | 9/1982 | Hall, III | |
| 4,383,377 | A | | 5/1983 | Crafton | |
| 4,389,562 | A | | 6/1983 | Chaudoir | |
| 4,398,310 | A | | 8/1983 | Lienhard | |
| 4,489,507 | A | | 12/1984 | Kawai | |
| 4,495,086 | A | | 1/1985 | Hiroshima et al. | |
| 4,497,999 | A | | 2/1985 | Postbeschild | |
| 4,564,956 | A | | 1/1986 | DiBuono | |
| 4,600,128 | A | | 7/1986 | Rohrer | |
| 4,625,432 | A | | 12/1986 | Baltes | |
| 4,629,864 | A | | 12/1986 | Wilson | |
| 4,665,630 | A | | 5/1987 | Postbeschild | |
| 4,677,764 | A | | 7/1987 | Cerny | |
| 4,704,806 | A | | 11/1987 | Gresens | |
| 4,734,017 | A | | 3/1988 | Levin | |
| 4,754,607 | A | | 7/1988 | Mackay | |
| 4,802,287 | A | | 2/1989 | Chen | |
| 4,809,444 | A | | 3/1989 | Henderson et al. | |
| 4,826,262 | A | | 5/1989 | Hartman et al. | |
| 4,843,653 | A | | 7/1989 | Coble | |
| 4,857,705 | A | | 8/1989 | Blevins | |
| 4,876,435 | A | | 10/1989 | Hawkins | |
| 4,908,959 | A | | 3/1990 | Kretchman et al. | |
| 4,914,833 | A | | 4/1990 | Pilolla et al. | |
| 4,928,402 | A | | 5/1990 | Allen | |
| 4,941,521 | A | | 7/1990 | Redekop et al. | |
| 4,952,432 | A | | 8/1990 | Ten Wolde | |
| 4,986,681 | A | | 1/1991 | Oliver | |
| 4,991,314 | A | | 2/1991 | Allen | |
| 4,993,172 | A | | 2/1991 | Allen | |
| 5,031,337 | A | | 7/1991 | Pilolla et al. | |
| 5,047,351 | A | | 9/1991 | Makiuchi et al. | |
| 5,064,154 | A | | 11/1991 | Payne | |
| 5,074,322 | A | | 12/1991 | Jaw | |
| 5,107,603 | A | | 4/1992 | Durazzani | |
| 5,111,594 | A | | 5/1992 | Allen | |
| 5,146,695 | A | | 9/1992 | Yang | |
| 5,152,852 | A | | 10/1992 | Hisamichi et al. | |
| 5,168,621 | A | | 12/1992 | Kruck et al. | |
| 5,186,360 | A | | 2/1993 | Mease et al. | |
| 5,249,370 | A | | 10/1993 | Stanger et al. | |
| 5,253,373 | A | | 10/1993 | Tsipov | |
| 5,280,679 | A | | 1/1994 | Edelman | |
| 5,318,754 | A | | 6/1994 | Collins et al. | |
| 5,320,627 | A | | 6/1994 | Sorensen et al. | |
| 5,374,118 | A | | 12/1994 | Kruck et al. | |
| 5,377,427 | A | | 1/1995 | Mashata | |
| 5,379,483 | A | | 1/1995 | Pino | |
| 5,379,525 | A | | 1/1995 | Raynor | |
| 5,397,028 | A | | 3/1995 | Jesadanont | |
| 5,406,718 | A | | 4/1995 | Stein | |
| 5,407,354 | A | | 4/1995 | Fife | |
| 5,407,723 | A | | 4/1995 | Curtin | |
| 5,423,249 | A | | 6/1995 | Meyer | |
| 5,436,092 | A | | 7/1995 | Ohtsuka et al. | |
| 5,459,944 | A | | 10/1995 | Tatsutani et al. | |
| 5,522,411 | A | | 6/1996 | Johnson | |
| 5,545,451 | A | | 8/1996 | Haung et al. | |
| 5,546,678 | A | | 8/1996 | Dhaemers | |
| 5,555,640 | A | | 9/1996 | Ou | |
| 5,601,870 | A | | 2/1997 | Haung et al. | |
| 5,612,083 | A | | 3/1997 | Haung et al. | |
| 5,620,249 | A | | 4/1997 | Musil | |
| 5,636,815 | A | | 6/1997 | Wilson | |
| 5,755,040 | A | | 5/1998 | Ou | |
| 5,870,836 | A | | 2/1999 | Grimes | |
| 5,873,178 | A | | 2/1999 | Johnson | |
| 5,875,562 | A | | 3/1999 | Fogarty | |
| 5,882,743 | A | | 3/1999 | McConnell | |
| 5,901,462 | A | | 5/1999 | Rudd | |
| 5,924,148 | A | | 7/1999 | Flowers, Sr. | |
| 5,945,068 | A | | 8/1999 | Ferone | |
| 5,972,474 | A | | 10/1999 | Tsuzuki et al. | |
| 5,974,685 | A | | 11/1999 | Hironaka | |
| 5,987,773 | A | | 11/1999 | Lipscy | |
| 6,005,227 | A | | 12/1999 | Pappas | |
| 6,018,885 | A | | 2/2000 | Hill | |

6,038,786 A 3/2000 Aisenberg et al.
6,047,485 A 4/2000 Madyun
6,050,000 A 4/2000 Curzon
6,050,275 A 4/2000 Kamikawa et al.
6,085,442 A 7/2000 Erickson
6,104,302 A 8/2000 Vuong
6,119,361 A 9/2000 Baker
6,119,437 A 9/2000 Baker
6,131,588 A 10/2000 Kamikawa et al.
6,137,067 A 10/2000 Helms et al.
6,158,673 A 12/2000 Toetschinger et al.
6,185,838 B1 2/2001 Moore
6,189,230 B1 2/2001 Huen
6,199,515 B1 3/2001 Clarke
6,206,980 B1 3/2001 Robinson
6,256,903 B1 7/2001 Rudd
6,263,591 B1 7/2001 La Porte
6,279,836 B1 8/2001 Toetschinger et al.
6,280,092 B1 8/2001 Backus et al.
6,282,812 B1 9/2001 Wee et al.
6,295,410 B1 9/2001 Helms et al.
6,298,777 B1 10/2001 Dubois et al.
6,342,104 B1 1/2002 Kamikawa et al.
6,431,189 B1 8/2002 Deibert
6,431,217 B2 8/2002 Robinson
6,606,801 B2 8/2003 Strang et al.
6,620,504 B2 9/2003 Mizumura et al.
6,624,606 B2 9/2003 Kushida et al.
6,651,357 B2 11/2003 Bria et al.
6,681,497 B2 1/2004 Bria et al.
6,684,648 B2 2/2004 Faqih
6,705,107 B2 3/2004 Schlosser et al.
6,732,858 B1 5/2004 Chang Ou
6,746,543 B2 6/2004 Kamikawa et al.
6,749,148 B2 6/2004 Helfer-Grand
6,766,589 B1 7/2004 Bory et al.
6,769,197 B1 8/2004 Tai
6,793,851 B1 9/2004 Bompay et al.
6,845,569 B1 1/2005 Kim
6,860,032 B2 3/2005 Meyer
6,892,475 B2 5/2005 Wakamatsu et al.
6,914,341 B1 7/2005 McIntyre
6,956,498 B1 10/2005 Gauthier et al.
6,962,235 B2 11/2005 Leon
6,973,740 B2 12/2005 Meyer
7,036,242 B2 5/2006 Komulainen et al.
7,036,575 B1 5/2006 Rodney et al.
7,039,301 B1 5/2006 Aisenberg et al.
7,040,021 B2 5/2006 Talavera
7,042,714 B2 5/2006 Hillman et al.
7,055,262 B2 6/2006 Goldberg et al.
7,087,117 B2 8/2006 Katsuoka et al.
7,150,890 B2 12/2006 Rosales et al.
7,182,820 B2 2/2007 Campbell et al.
7,284,391 B2 10/2007 Miller et al.
7,309,376 B2 12/2007 Barre et al.
7,316,080 B1 1/2008 Woolsey
7,380,348 B2 * 6/2008 Seebach ..... 34/326
7,437,833 B2 10/2008 Sato et al.
7,442,257 B2 10/2008 Katsuoka et al.
7,506,458 B2 3/2009 Lee et al.
7,509,998 B1 3/2009 Rodney
7,526,833 B2 5/2009 Cochran et al.
7,555,209 B2 6/2009 Pradas Diez et al.
7,562,543 B2 7/2009 Kendall et al.
7,575,636 B2 8/2009 Katsuoka et al.
7,587,917 B2 9/2009 Gilboe et al.
7,596,883 B2 10/2009 Kameishi
7,597,122 B1 10/2009 Smith
7,614,160 B2 11/2009 Kameishi et al.
7,617,702 B2 11/2009 Sunshine et al.
7,624,600 B2 12/2009 Sunshine et al.
7,628,043 B2 12/2009 Sunshine et al.
7,640,678 B2 1/2010 Lee et al.
7,653,963 B2 2/2010 Cochran et al.
7,665,225 B2 2/2010 Goldberg et al.
7,802,340 B2 9/2010 Knopow et al.
7,832,697 B2 11/2010 West et al.
7,856,736 B2 12/2010 Churchill et al.
7,946,055 B2 5/2011 Churchill et al.
2001/0000576 A1 5/2001 Robinson
2001/0027795 A1 10/2001 Cain-Kozma et al.
2002/0004994 A1 1/2002 Rudd
2002/0046569 A1 4/2002 Faqih
2002/0078705 A1 6/2002 Schlosser et al.
2002/0092198 A1 7/2002 Bria et al.
2002/0132214 A1 9/2002 Mattson et al.
2002/0185987 A1 12/2002 Kushida et al.
2002/0198662 A1 12/2002 Chen
2003/0000036 A1 1/2003 Fan
2003/0001468 A1 1/2003 Hase et al.
2003/0066281 A1 4/2003 Mizumura et al.
2003/0071075 A1 4/2003 Frankenbach et al.
2003/0074718 A1 4/2003 English
2003/0159718 A1 8/2003 Kamikawa et al.
2003/0172547 A1 9/2003 Shephard, II
2003/0188448 A1 10/2003 Reed
2004/0031119 A1 2/2004 McKay
2004/0045168 A1 3/2004 Talavera
2004/0049940 A1 3/2004 Komulainen et al.
2004/0088817 A1 5/2004 Cochran et al.
2004/0090040 A1 5/2004 Pearson
2004/0108281 A1 6/2004 Gerteis et al.
2004/0111817 A1 6/2004 Chen et al.
2004/0168342 A1 9/2004 Wakamatsu et al.
2004/0226312 A1 11/2004 Miller et al.
2004/0244090 A1 12/2004 Langer
2004/0255484 A1 12/2004 Storrer et al.
2005/0036283 A1 2/2005 Hillman et al.
2005/0066538 A1 3/2005 Goldberg et al.
2005/0072358 A1 4/2005 Katsuoka et al.
2005/0076529 A1 4/2005 Holmes
2005/0076662 A1 4/2005 Roche et al.
2005/0100436 A1 5/2005 Egusquiza
2005/0120508 A1 6/2005 Morgan et al.
2005/0153002 A1 7/2005 Socla Rosales et al.
2005/0211357 A1 9/2005 Ren
2005/0258114 A1 11/2005 Davis
2005/0262720 A1 12/2005 Rane et al.
2005/0273969 A1 12/2005 Watson et al.
2006/0000110 A1 1/2006 Aisenberg et al.
2006/0036198 A1 2/2006 Cafaro et al.
2006/0060082 A1 3/2006 Barre et al.
2006/0096118 A1 5/2006 Ward, III et al.
2006/0171660 A1 8/2006 Hsu
2006/0179676 A1 8/2006 Goldberg et al.
2006/0180596 A1 8/2006 Young et al.
2006/0191901 A1 8/2006 Taylor et al.
2006/0201015 A1 9/2006 Russell
2006/0201018 A1 9/2006 McKay et al.
2006/0206233 A1 9/2006 Carpenter et al.
2006/0230630 A1 10/2006 Lee et al.
2006/0236929 A1 10/2006 Katsuoka et al.
2006/0243204 A1 11/2006 Katsuoka et al.
2006/0243205 A1 11/2006 Katsuoka et al.
2006/0272120 A1 12/2006 Barrick et al.
2006/0272170 A1 12/2006 Holmes
2006/0288508 A1 12/2006 Knopow et al.
2007/0033937 A1 2/2007 Baur et al.
2007/0079524 A1 4/2007 Sato et al.
2007/0094884 A1 5/2007 Micheludis
2007/0113369 A1 5/2007 Cochran et al.
2007/0144034 A1 6/2007 Kameishi
2007/0160515 A1 7/2007 Mohrman
2007/0163141 A1 7/2007 Hsu
2007/0263994 A1 11/2007 Diez et al.
2007/0274822 A1 11/2007 Liu et al.
2007/0290110 A1 12/2007 West et al.
2008/0004963 A1 1/2008 Montalbano et al.
2008/0022551 A1 1/2008 Banta et al.
2008/0032066 A1 2/2008 Stiblert et al.
2008/0052952 A1 3/2008 Nelson
2008/0127830 A1 6/2008 Le et al.
2008/0209760 A1 * 9/2008 French et al. ..... 34/585
2008/0216342 A1 9/2008 Kameishi et al.
2008/0216343 A1 9/2008 Churchill et al.
2008/0216344 A1 9/2008 Churchill et al.
2008/0222910 A1 9/2008 Churchill et al.

| | | | |
|---|---|---|---|
| 2008/0253754 | A1 | 10/2008 | Rubin |
| 2008/0256825 | A1 | 10/2008 | Hsu |
| 2008/0259566 | A1 | 10/2008 | Fried |
| 2008/0263889 | A1 | 10/2008 | Fukaya et al. |
| 2008/0272734 | A1 | 11/2008 | Ren |
| 2008/0301970 | A1 | 12/2008 | Hackwell et al. |
| 2008/0313918 | A1 | 12/2008 | Dyson et al. |
| 2008/0313919 | A1 | 12/2008 | Churchill et al. |
| 2008/0317448 | A1 | 12/2008 | Brown et al. |
| 2009/0000142 | A1 | 1/2009 | Churchill et al. |
| 2009/0004962 | A1 | 1/2009 | Collins |
| 2009/0034946 | A1 | 2/2009 | Caine et al. |
| 2009/0044420 | A1 | 2/2009 | Hsu |
| 2009/0071030 | A1 | 3/2009 | Myung et al. |
| 2009/0077736 | A1 | 3/2009 | Loberger et al. |
| 2009/0113746 | A1 | 5/2009 | Churchill et al. |
| 2009/0113748 | A1 | 5/2009 | Dyson et al. |
| 2009/0119942 | A1 | 5/2009 | Aisenberg et al. |
| 2009/0130745 | A1 | 5/2009 | Williams et al. |
| 2009/0195877 | A1 | 8/2009 | Nakai |
| 2009/0221059 | A1 | 9/2009 | Williams et al. |
| 2009/0236629 | A1 | 9/2009 | Nishikawa et al. |
| 2009/0255142 | A1 | 10/2009 | Brown |
| 2009/0293304 | A1 | 12/2009 | Yang |
| 2009/0320316 | A1 | 12/2009 | Zakai |
| 2010/0005614 | A1 | 1/2010 | Cochran et al. |
| 2010/0024244 | A1 | 2/2010 | Potter |
| 2010/0052408 | A1 | 3/2010 | Ren |
| 2010/0119755 | A1 | 5/2010 | Chung et al. |
| 2010/0130686 | A1 | 5/2010 | Oshima |
| 2010/0154239 | A1 | 6/2010 | Hutchinson |
| 2010/0154863 | A1 | 6/2010 | Bennett et al. |
| 2010/0192399 | A1 | 8/2010 | Sawabe et al. |
| 2010/0209080 | A1 | 8/2010 | Rubin et al. |
| 2010/0210745 | A1 | 8/2010 | McDaniel et al. |
| 2010/0212177 | A1 | 8/2010 | Chen |
| 2010/0227963 | A1 | 9/2010 | Hironaka et al. |
| 2011/0082021 | A1 | 4/2011 | Burns |
| 2011/0099834 | A1 | 5/2011 | Brown |
| 2011/0131829 | A1 | 6/2011 | Zagar et al. |

FOREIGN PATENT DOCUMENTS

| | | | |
|---|---|---|---|
| CA | 1124057 | | 5/1982 |
| CH | 645277 | | 9/1984 |
| CH | 658372 | | 11/1986 |
| CH | 669116 | | 2/1989 |
| CN | 2684294 | | 3/2005 |
| CZ | 15 805 | | 11/2005 |
| DE | 548998 | | 4/1932 |
| DE | 26 57 164 | A1 | 6/1978 |
| DE | 3116285 | | 2/1983 |
| DE | 3204258 | | 8/1983 |
| DE | 3218578 | | 11/1983 |
| DE | 3440412 | | 3/1986 |
| DE | 3530888 | | 3/1986 |
| DE | 3443438 | | 5/1986 |
| DE | 3443439 | | 5/1986 |
| DE | 3508316 | | 9/1986 |
| DE | 3513159 | | 10/1986 |
| DE | 3527835 | | 2/1987 |
| DE | 3529410 | | 2/1987 |
| DE | 3735197 | | 5/1989 |
| DE | 3814489 | | 11/1989 |
| DE | 4022003 | | 1/1992 |
| DE | 4107439 | | 9/1992 |
| DE | 4107489 | | 9/1992 |
| DE | 4218658 | | 12/1992 |
| DE | 4208680 | | 9/1993 |
| DE | 4428978 | | 3/1995 |
| DE | 196 12 923 | | 10/1997 |
| DE | 19654756 | | 7/1998 |
| DE | 10109237 | | 9/2002 |
| DE | 101 14 473 | | 10/2002 |
| DE | 10147778 | | 4/2003 |
| DE | 10157975 | | 6/2003 |
| EP | 0 059 888 | | 9/1982 |
| EP | 0 068 491 | | 1/1983 |
| EP | 0 211 418 | | 2/1987 |
| EP | 251898 | | 1/1988 |
| EP | 329171 | | 8/1989 |
| EP | 0 357 305 | | 3/1990 |
| EP | 382521 | | 8/1990 |
| EP | 393254 | | 10/1990 |
| EP | 0 438 208 | | 7/1991 |
| EP | 0567678 | | 11/1993 |
| EP | 0574160 | | 12/1993 |
| EP | 0 589 568 | | 3/1994 |
| EP | 0644334 | | 3/1995 |
| EP | 0679358 | | 11/1995 |
| EP | 832697 | | 4/1998 |
| EP | 855736 | | 7/1998 |
| EP | 976356 | | 2/2000 |
| EP | 1166704 | | 1/2002 |
| EP | 1250878 | | 10/2002 |
| EP | 1250879 | | 10/2002 |
| FR | 2 537 425 | | 6/1984 |
| FR | 2543592 | | 10/1984 |
| FR | 2569029 | | 2/1986 |
| FR | 2577109 | | 8/1986 |
| FR | 2582196 | | 11/1986 |
| FR | 2588741 | | 4/1987 |
| FR | 2595455 | | 9/1987 |
| FR | 2 597 717 | | 10/1987 |
| FR | 2790979 | | 9/2000 |
| GB | 493258 | | 10/1938 |
| GB | 680148 | | 10/1952 |
| GB | 1024671 | | 3/1966 |
| GB | 2 012 362 | | 7/1979 |
| GB | 2050609 | | 1/1981 |
| GB | 2054151 | | 2/1981 |
| GB | 2057528 | | 4/1981 |
| GB | 2085725 | | 5/1982 |
| GB | 2112639 | | 7/1983 |
| GB | 2116034 | | 9/1983 |
| GB | 2 136 291 | | 9/1984 |
| GB | 2137878 | | 10/1984 |
| GB | 2142128 | | 1/1985 |
| GB | 2144325 | | 3/1985 |
| GB | 2147804 | | 5/1985 |
| GB | 2 179 856 | | 3/1987 |
| GB | 2 189 382 | | 10/1987 |
| GB | 2196843 | | 5/1988 |
| GB | 2198229 | | 6/1988 |
| GB | 2236248 | | 4/1991 |
| GB | 2 249 026 | | 4/1992 |
| GB | 2 253 035 | | 8/1992 |
| GB | 2 405 583 | | 3/2005 |
| GB | 2 434 094 | | 7/2007 |
| JP | 59-200143 | | 11/1984 |
| JP | 61-21393 | U | 2/1986 |
| JP | 63-154138 | A | 6/1988 |
| JP | 63-163693 | | 10/1988 |
| JP | 63-279033 | | 11/1988 |
| JP | 2-52973 | | 2/1990 |
| JP | 3-82419 | A | 4/1991 |
| JP | 3-82420 | A | 4/1991 |
| JP | 4-73026 | A | 3/1992 |
| JP | 5-49553 | | 3/1993 |
| JP | 6-62979 | | 3/1994 |
| JP | 6-63909 | | 3/1994 |
| JP | 6-209879 | | 8/1994 |
| JP | 7-79880 | | 3/1995 |
| JP | 7-116076 | | 5/1995 |
| JP | 7-280419 | | 10/1995 |
| JP | 7-308266 | | 11/1995 |
| JP | 8-187209 | | 7/1996 |
| JP | 8-196470 | | 8/1996 |
| JP | 8-196798 | | 8/1996 |
| JP | 8-291703 | | 11/1996 |
| JP | 8-318176 | | 12/1996 |
| JP | 9-66003 | | 3/1997 |
| JP | 9-135789 | | 5/1997 |
| JP | 10-113304 | | 5/1998 |
| JP | 10-248748 | | 9/1998 |
| JP | 10-281627 | | 10/1998 |
| JP | 11-283 | | 1/1999 |
| JP | 11-18999 | | 1/1999 |
| JP | 11-56673 | | 3/1999 |

| | | | |
|---|---|---|---|
| JP | 11-70058 | | 3/1999 |
| JP | 11-178742 | | 7/1999 |
| JP | 11-178744 | | 7/1999 |
| JP | 11-244191 | | 9/1999 |
| JP | 11-287544 | | 10/1999 |
| JP | 2000-178 | | 1/2000 |
| JP | 2000-107073 | | 4/2000 |
| JP | 2000-157447 | | 6/2000 |
| JP | 2000-157448 | | 6/2000 |
| JP | 2000-245653 | A | 9/2000 |
| JP | 2000-300465 | | 10/2000 |
| JP | 2000-308598 | | 11/2000 |
| JP | 2000-316747 | | 11/2000 |
| JP | 2001-37675 | | 2/2001 |
| JP | 2001-87163 | | 4/2001 |
| JP | 2001-149262 | | 6/2001 |
| JP | 2001-157647 | | 6/2001 |
| JP | 2001-275898 | | 10/2001 |
| JP | 2001-346715 | | 12/2001 |
| JP | 2002-34835 | A | 2/2002 |
| JP | 2002-34841 | | 2/2002 |
| JP | 2002-34843 | | 2/2002 |
| JP | 2002-34844 | | 2/2002 |
| JP | 2002-34845 | | 2/2002 |
| JP | 2002-34852 | | 2/2002 |
| JP | 2002-136448 | | 5/2002 |
| JP | 2002-306370 | A | 10/2002 |
| JP | 2002-345681 | | 12/2002 |
| JP | 2003-153823 | | 5/2003 |
| JP | 2003-180554 | A | 7/2003 |
| JP | 2003-180555 | | 7/2003 |
| JP | 2003-235757 | | 8/2003 |
| JP | 2003-275129 | | 9/2003 |
| JP | 2004-97840 | | 4/2004 |
| JP | 2004-105511 | A | 4/2004 |
| JP | 2004-113615 | | 4/2004 |
| JP | 2004-113712 | | 4/2004 |
| JP | 2004-215879 | | 8/2004 |
| JP | 2004-231935 | | 8/2004 |
| JP | 2004-261275 | | 9/2004 |
| JP | 2004-261510 | | 9/2004 |
| JP | 2004-305287 | | 11/2004 |
| JP | 2004-357820 | | 12/2004 |
| JP | 2005-27693 | | 2/2005 |
| JP | 2005-160872 | | 6/2005 |
| JP | 2005-160874 | | 6/2005 |
| JP | 2005-168799 | | 6/2005 |
| JP | 2005-177415 | | 7/2005 |
| JP | 2005-198933 | | 7/2005 |
| JP | 2005-291274 | | 10/2005 |
| JP | 2006-187397 | | 7/2006 |
| JP | 2006-263152 | | 10/2006 |
| WO | WO-85/03462 | | 8/1985 |
| WO | WO-85/04184 | | 9/1985 |
| WO | WO-86/06693 | | 11/1986 |
| WO | WO-87/07040 | | 11/1987 |
| WO | WO 97/34708 | | 9/1997 |
| WO | WO-98/26703 | | 6/1998 |
| WO | WO-98/53752 | | 12/1998 |
| WO | WO-99/53250 | | 10/1999 |
| WO | WO-01/25705 | | 4/2001 |
| WO | WO-03/024291 | | 3/2003 |
| WO | WO-2004/100743 | | 11/2004 |
| WO | WO 2005/029687 | | 3/2005 |
| WO | WO-2005/074776 | | 8/2005 |
| WO | WO 2007/015040 | | 2/2007 |
| WO | WO-2007/015042 | | 2/2007 |
| WO | WO-2007/015044 | | 2/2007 |
| WO | WO 2007/015045 | | 2/2007 |
| WO | WO 2007015039 | A1 * | 2/2007 |

OTHER PUBLICATIONS

GB Search Report dated Nov. 18, 2005, directed to counterpart GB Application No. GB0515754.0 (1 page).
GB Search Report dated Aug. 25, 2006, directed to GB Application No. GB0600881.7; 1 page.
GB Search Report dated Oct. 28, 2005, directed to GB Application No. GB0515744.1; 1 page.
International Search Report mailed Aug. 7, 2006, directed to International Application No. PCT/GB2006/002138; 1 page.
GB Search Report dated Oct. 27, 2005, directed to GB Application No. GB0515752.4; 1 page.
GB Search Report dated Nov. 24, 2005, directed to GB Application No. GB0515752.4; 1 page.
International Search Report dated Jul. 17, 2006, directed to International Application No. PCT/GB2006/002139; 1 page.
GB Search Report dated Oct. 27, 2005, directed to GB Application No. GB0515749.0; 1 page.
International Search Report dated Aug. 25, 2006, directed to International Application No. PCT/GB2006/002199; 2 pages.
GB Search Report mailed Mar. 27, 2006, directed to GB Application No. 0600534.2; 1 page.
International Search Report mailed Mar. 16, 2007, directed to International Application No. PCT/GB2007/000089; 4 pages.
Churchill et al., U.S. Office Action mailed Apr. 1, 2010, directed to U.S. Appl. No. 11/997,301; 10 pages.
Churchill et al., U.S. Office Action mailed Apr. 1, 2010, directed to U.S. Appl. No. 11/997,303; 9 pages.
Churchill et al., U.S. Office Action mailed Aug. 17, 2010, directed to U.S. Appl. No. 11/997,303; 7 pages.
Churchill et al., U.S. Office Action mailed Oct. 22, 2010, directed to U.S. Appl. No. 11/997,301; 15 pages.
Dyson et al., U.S. Office Action mailed Jul. 22, 2011, directed to U.S. Appl. No. 11/997,302; 14 pages.
Dyson et al., U.S. Office Action mailed Aug. 8, 2011, directed to U.S. Appl. No. 11/997,308; 8 pages.
Caine et al., U.S. Office Action mailed Jul. 8, 2011, directed to U.S. Appl. No. 12/159,559; 6 pages.
Hutchinson, U.S. Office Action mailed Jun. 24, 2010, directed to U.S. Appl. No. 12/160,961; 8 pages.
Hutchinson, U.S. Office Action mailed Dec. 9, 2010, directed to U.S. Appl. No. 12/160,961; 10 pages.
Hackwell et al., U.S. Office Action mailed Apr. 4, 2011, directed to U.S. Appl. No. 11/997,305; 7 pages.
Churchill et al., U.S. Office Action mailed Aug. 12, 2011, directed to U.S. Appl. No. 11/997,311; 7 pages.
Churchill et al., U.S. Office Action mailed Sep. 28, 2011, directed to U.S. Appl. No. 11/997,310; 7 pages.
Hackwell et al., U.S. Office Action mailed Oct. 17, 2011, directed to U.S. Appl. No. 11/997,305; 7 pages.
Dyson et al., U.S. Office Action mailed Jan. 18, 2012, directed to U.S. Appl. No. 11/997,308; 7 pages.
Churchill et al., U.S. Office Action mailed Feb. 13, 2012, directed to U.S. Appl. No. 11/997,310; 5 pages.
Hutchinson, U.S. Office Action mailed Mar. 19, 2012, directed to U.S. Appl. No. 12/160,961; 8 pages.
Churchill et al., U.S. Office Action mailed Mar. 23, 2012, directed to U.S. Appl. No. 11/997,311; 7 pages.

* cited by examiner

DRYING APPARATUS

REFERENCE TO RELATED APPLICATIONS

This application is a national stage application under 35 USC 371 of International Application No. PCT/GB2006/002084, filed Jun. 7, 2006, which claims the priority of United Kingdom Application No. 0515754.0, filed Jul. 30, 2005, the contents of which prior applications are incorporated herein by reference.

FIELD OF THE INVENTION

The invention relates to drying apparatus which makes use of a narrow jet of high velocity, high pressure air to dry an object, including part of the human body. Particularly, but not exclusively, the invention relates to a hand dryer in which the air jet is emitted through a slot-like opening in the casing of the hand dryer.

BACKGROUND OF THE INVENTION

The use of air jets to dry hands is well known. Examples of hand dryers which emit at least one air jet through a slot-like opening are shown in GB 2249026A, JP 2002-034835A and JP 2002306370A. However, in practice it is very difficult to achieve an evenly distributed airflow of sufficiently high momentum to dry the user's hands efficiently in an acceptably short length of time. Furthermore, the amount of noise emitted by a motor suitable for generating an airflow of sufficiently high momentum adequately to dry the user's hands can be unacceptably high.

SUMMARY OF THE INVENTION

It is an object of the invention to provide drying apparatus in which an airflow of sufficient momentum efficiently to dry the user's hands is produced and in which the noise emitted by the motor is improved in comparison to prior art devices. It is a further object of the present invention to provide drying apparatus in which the noise emitted by the apparatus is comparatively low.

A first aspect of the invention provides drying apparatus having a casing, a cavity formed in the casing for receiving an object, a fan located in the casing and capable of creating an airflow, a motor provided in the casing for driving the fan and ducting for carrying the airflow from the fan to at least one opening arranged to emit the airflow into the cavity, wherein the ducting comprises at least one air duct in which at least one vane is located, the or each vane extending in the direction of airflow and dividing the air duct into a plurality of airflow portions.

Preferably, the or each vane is positioned in the air duct such that the distance between the said vane and any adjacent wall of the air duct or further vane is no more than a predetermined value. This predetermined value is determined in such a way that it is no greater than the half-wavelength of the noise emitted by the motor. In this way, standing waves are prevented form building up in the air duct but plane waves are allowed to pass along the air duct. This reduces the noise emitted by the machine overall and so enhances the comfort with which the user is able to use the drying apparatus.

The predetermined value is therefore calculated as a function of both the operating speed of the motor and the speed of sound in the airflow passing along the air duct. Motor speeds vary from product to product and the speed of sound in the airflow will depend upon the expected operating temperature of the apparatus. However, an optimum predetermined value can be calculated. The formula to be used is thus:

$$\text{Predetermined Value} = \frac{30 \times \text{Speed of sound in air duct}}{\text{Operating speed of the motor}}$$

If the normal operating temperature of the apparatus is approximately 55° C., this can be simplified to:

$$\text{Predetermined Value} = \frac{10800}{\text{Operating speed of the motor}}$$

In a preferred embodiment, the operating speed of the motor is substantially 90,000 rpm which puts the predetermined value at 120 mm, although the preferred range of predetermined values is between 100 mm and 150 mm. In the embodiment, the distance between any point on the or each vane and the wall of the air duct or adjacent vane (measured in a direction perpendicular to the airflow) is sufficiently small to prevent standing waves being able to build up. The noise of the hand dryer is thus improved in comparison to the noise which would have been emitted absent the vanes.

It is preferred that more than one vane is arranged in the or each air duct and that the vanes are arranged in rows, more preferably rows which overlap one another. If the breadth of each air duct increases in the direction of the airflow, each successive row of vanes has a higher number of vanes than the previous row.

The provision of the vanes in the air ducts assists in strengthening the structure of the air ducts and their direction helps to maintain the direction of airflow within the ducts, particularly as the duct becomes broader.

BRIEF DESCRIPTION OF THE DRAWINGS

An embodiment of the invention in the form of a hand dryer will now be described with reference to the accompanying drawings, in which.

DETAILED DESCRIPTION OF THE INVENTION

Figure 2:
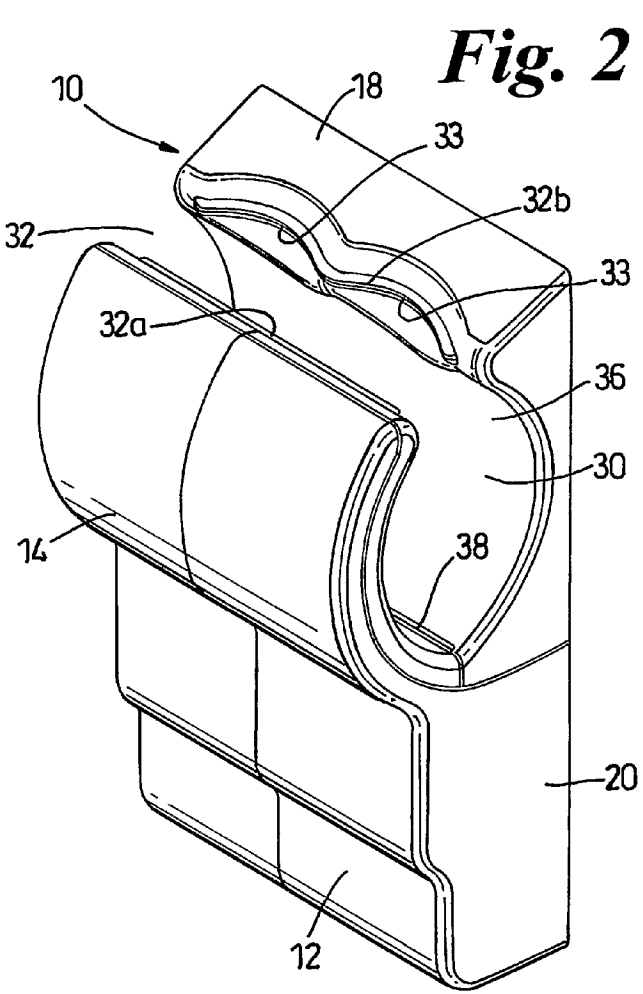
FIG. 2 is a perspective view of the hand dryer of FIG. 1.
Figure 1:
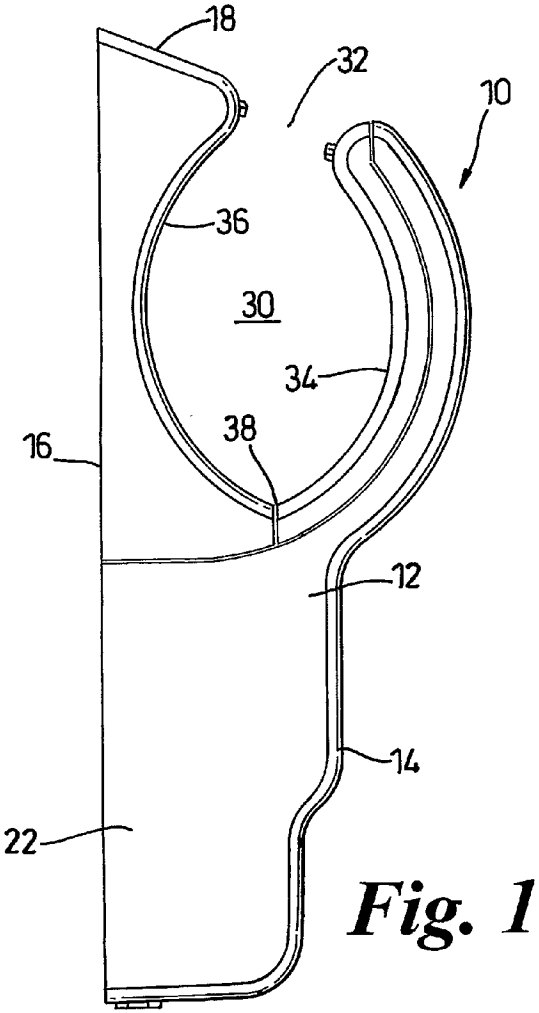
FIG. 1 is a side view of drying apparatus according to the invention in the form of a hand dryer.

Referring firstly to FIGS. 1 and 2, the hand dryer 10 shown in the drawings comprises an outer casing 12 having a front wall 14, a rear wall 16, an upper face 18 and side walls 20, 22. The rear wall 16 can incorporate fixing devices (not shown) for securing the hand dryer 10 to a wall or other structure prior to use. An electrical connection (not shown) is also provided on the rear wall or elsewhere on the casing 12. A cavity 30 is formed in the upper part of the casing 12 as can be seen from FIGS. 1 and 2. The cavity 30 is open at its upper end and delimited thereat by the top of the front wall 14 and the front of the upper face 18. The space between the top of the front wall 14 and the front of the upper face 18 forms a cavity entrance 32 which is sufficiently wide to allow a user's hands to be introduced to the cavity 30 through the cavity entrance 32. The cavity 30 is also open to the sides of the hand dryer 10 by appropriate shaping of the side walls 20, 22.

The cavity 30 has a front wall 34 and a rear wall 36 which delimit the cavity 30 to the front and rear respectively. Located in the lowermost end of the cavity 30 is a drain 38 which communicates with a reservoir (not shown) located in the lower part of the casing 12. The purpose of the drain and reservoir will be described below.

Figure 3:
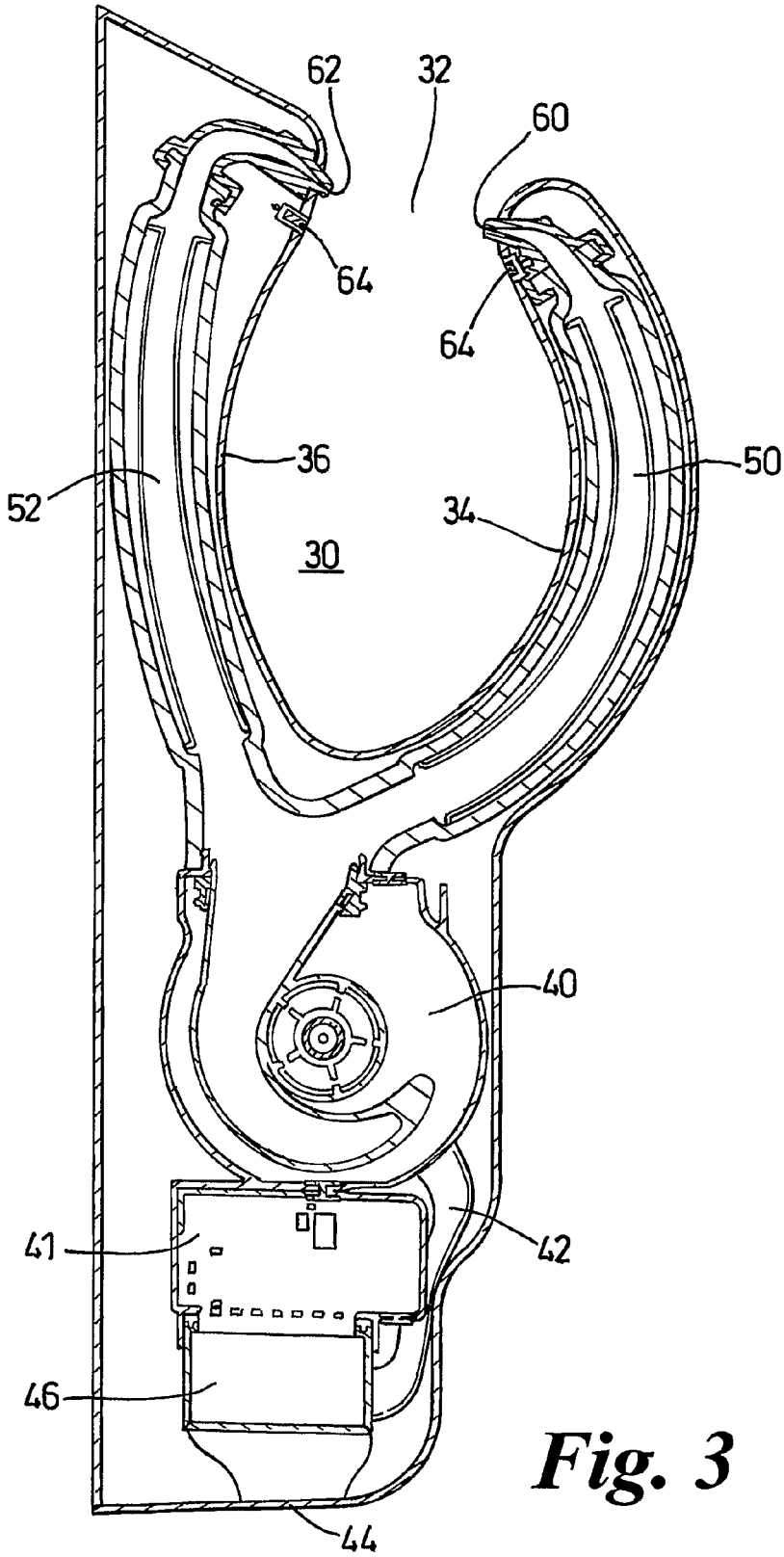
FIG. 3 is a side sectional view of the hand dryer of FIG. 1.

As shown in FIG. 3, a motor (not shown) is located inside the casing 12 and a fan 40, which is driven by the motor, is also located inside the casing 12. The motor is connected to the electrical connection and is controlled by a controller 41. The inlet 42 of the fan 40 communicates with an air inlet 44 formed in the casing 12. A filter 46 is located in the air passageway connecting the air inlet 44 to the fan inlet 42 so as to prevent the ingress of any debris which might cause damage to the motor or the fan 40. The outlet of the fan 40 communicates with a pair of air ducts 50, 52 which are located inside the casing 12. The front air duct 50 is located primarily between the front wall 14 of the casing 12 and the front wall 34 of the cavity 30, and the rear air duct 52 is located primarily between the rear wall 16 of the casing 12 and the rear wall 36 of the cavity 30.

The air ducts 50, 52 are arranged to conduct air from the fan 40 to a pair of opposed slot-like openings 60, 62 which are located in the front and rear walls 34, 36 respectively of the cavity 30. The slot-like openings 60, 62 are arranged at the upper end of the cavity 30 in the vicinity of the cavity entrance 32. The slot-like openings 60, 62 are each configured so as to direct an airflow generally across the cavity entrance 32 towards the opposite wall of the cavity 30. The slot-like openings 60, 62 are offset in the vertical direction and angled towards the lowermost end of the cavity 30.

Figure 4:
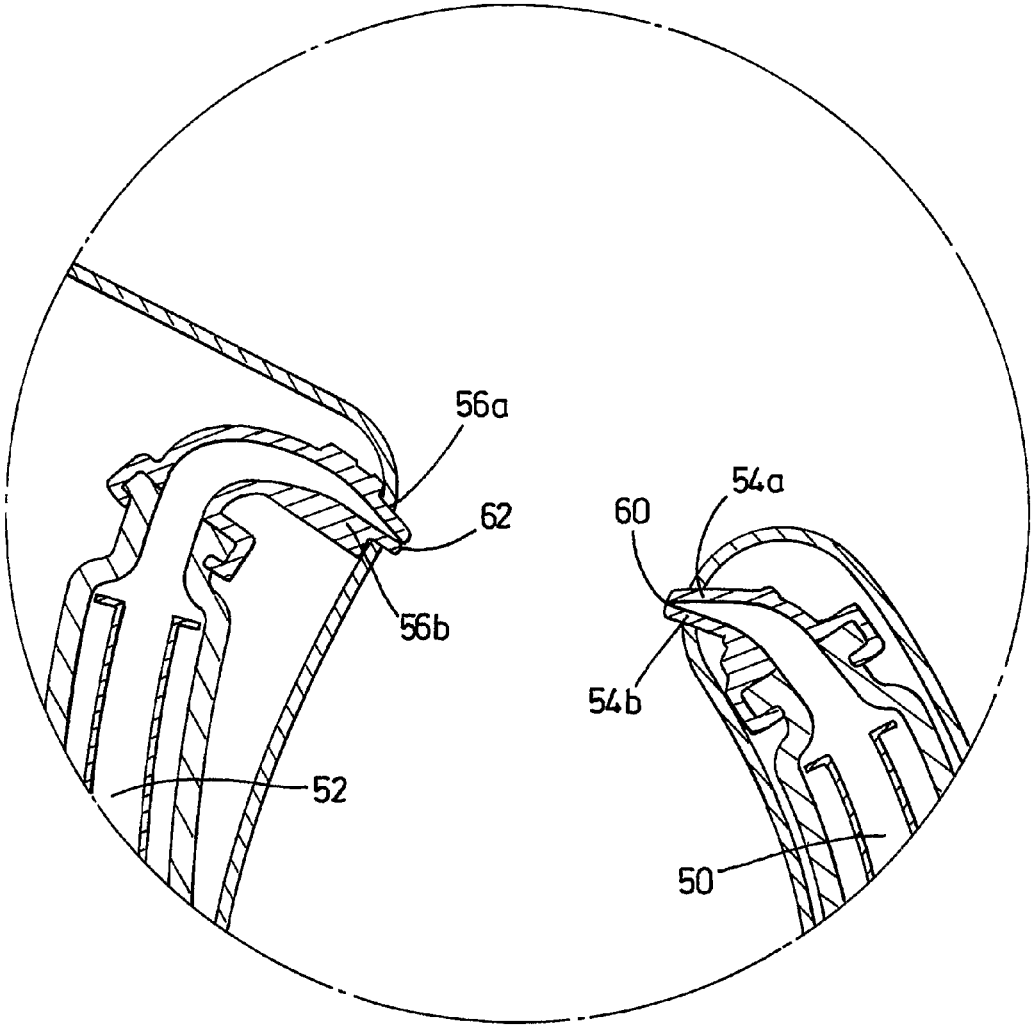
FIG. 4 is a side sectional view, shown on an enlarged scale, of the upper ends of the air ducts forming part of the hand dryer of FIG. 1.
Figure 5:
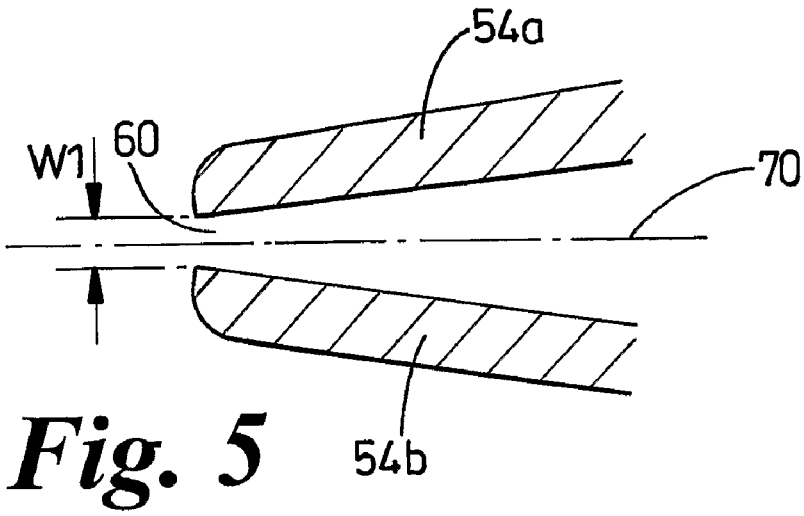
FIG. 5 is a schematic sectional side view, shown on a further enlarged scale, of the slot-like opening located in the front wall of the cavity of the hand dryer of FIG. 1.
Figure 6:
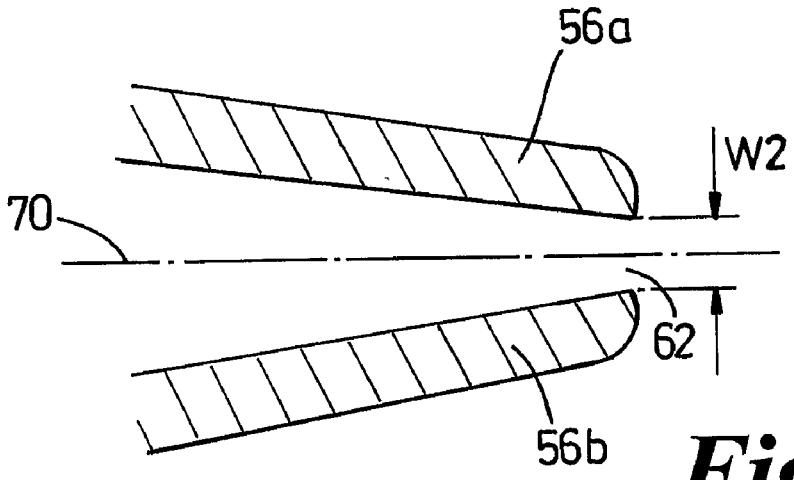
FIG. 6 is a schematic sectional side view, shown on the same further enlarged scale, of the slot-like opening located in the rear wall of the cavity of the hand dryer of FIG. 1.

FIG. 4 shows the upper ends of the air ducts 50, 52 and the slot-like openings 60, 62 in greater detail. As can be seen, the walls 54*a*, 54*b* of the air duct 50 converge to form the slot-like opening 60 and the walls 56*a*, 56*b* of the air duct 52 converge to form the slot-like opening 62. Even greater detail can be seen in FIGS. 5 and 6. FIG. 5 shows that the slot-like opening 60 has a width of W1 and FIG. 6 shows that the slot-like opening 62 has a width of W2. The width W1 of the slot-like opening 60 is smaller than the width W2 of the slot-like opening 62. The width W1 is 0.3 mm and the width W2 is 0.4 mm.

Each pair of walls 54*a*, 54*b*, 56*a*, 56*b* is arranged so that the respective walls approach one another as they approach the respective slot-like opening 60, 62. If an imaginary axis 70 is considered to lie midway between each pair of walls, as is shown in FIGS. 5 and 6, then each wall 54*a*, 54*b*, 56*a*, 56*b* lies at an angle of substantially 7° to the respective axis 70. Thus the angle formed between each pair of walls 54*a*, 54*b*, 56*a*, 56*b* is thus substantially 14°. This angle has been found to be advantageous, although it could be varied by several degrees. Angles of between 100 and 200 may be used.

Sensors 64 are positioned in the front and rear walls 34, 36 of the cavity 30 immediately below the slot-like openings 60, 62. These sensors 64 detect the presence of a user's hands which are inserted into the cavity 30 via the cavity entrance 32 and are arranged to send a signal to the motor when a user's hands are introduced to the cavity 30. As can be seen from FIGS. 1 and 3, the walls 54*a*, 54*b*, 56*a*, 56*b* of the ducts 50, 52 project slightly beyond the surface of the front and rear walls 34, 36 of the cavity 30. The inward projection of the walls 54*a*, 54*b*, 56*a*, 56*b* of the ducts 50, 52 reduces the tendency of the user's hands to be sucked towards one or other of the walls 34, 36 of the cavity, which enhances the ease with which the hand dryer 10 can be used. The positioning of the sensors 64 immediately below the inwardly projecting walls 54*a*, 54*b*, 56*a*, 56*b* of the ducts 50, 52 also reduces the risk of the sensors 64 becoming dirty and inoperative.

As can be seen from FIG. 2, the shape of the cavity entrance 32 is such that the front edge 32*a* is generally straight and extends laterally across the width of the hand dryer 10. However, the rear edge 32*b* has a shape which consists of two curved portions 33 which generally follow the shape of the backs of a pair of human hands as they are inserted downwardly into the cavity 30 through the cavity entrance 32. The rear edge 32*b* of the cavity entrance 32 is substantially symmetrical about the centre line of the hand dryer 10. The intention of the shaping and dimensioning of the front and rear edges 32*a*, 32*b* of the cavity entrance 32 is that, when a user's hands are inserted into the cavity 30 through the cavity entrance 32, the distance from any point on the user's hands to the nearest slot-like opening is substantially uniform.

Figure 7:
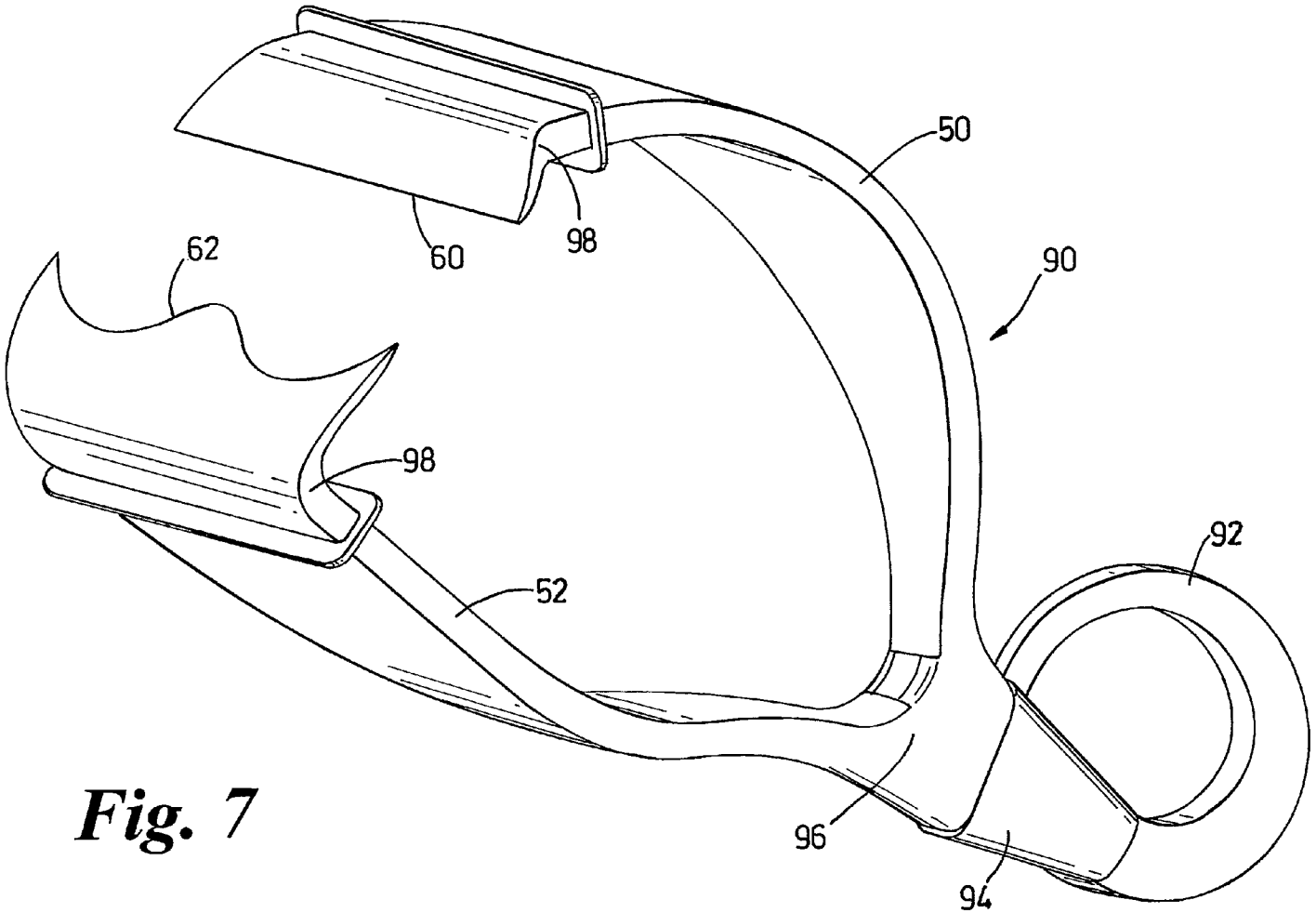
FIG. 7 is an isometric view of the ducting forming part of the hand dryer of FIG. 1 shown in isolation from the other components of the apparatus.

The air ducts 50, 52 form part of the ducting 90 which lies between the fan 40 and the slot-like openings 60, 62. A perspective view of the ducting 90 is shown in FIG. 7. The ducting 90 includes a scroll 92 which lies adjacent the fan 40 and receives the airflow generated by the fan 40. The scroll 92 communicates with a first chamber 94 which is generally square in cross-section, although the cross-section could easily be generally circular. The intention is that the cross-section of the chamber 94 should have dimensions which are substantially the same in both directions. Immediately downstream of the chamber 94 is a Y-junction 96 downstream of which the air ducts 50, 52 are located. As has been described above, the air ducts 50, 52 pass towards the upper end of the casing 12 with the front air duct 50 being located between the front wall 14 of the casing 12 and the front wall 34 of the cavity 30 and the rear duct 52 being located between the rear wall 16 of the casing 12 and the rear wall 36 of the cavity 30. The air ducts 50, 52 communicate with the slot-like openings 60, 62 at the upper end of the cavity 30.

The ducting 90 is designed so that the cross-sectional area of the ducting 90 gradually transforms from the generally square (or circular) shape of the chamber 94 to the slot-like shape of the openings in a smooth and gradual manner. Immediately downstream of the chamber 94, the ducting divides into the air ducts 50, 52, at the upstream end of which the cross-sectional area is still generally square in shape—ie, the breadth and depth of the cross-section are substantially similar. However, the cross-section changes gradually with distance from the chamber 94 so that the breadth of each duct 50, 52 increases as the depth reduces. All of the changes are smooth and gradual to minimise any frictional losses.

At a point 98 immediately upstream of each of the slot-like openings 60, 62, the cross-sectional area of each of the air ducts 60, 62 begins to decrease so as to cause the velocity of the airflow travelling towards the slot-like openings 60, 62 to increase dramatically. However, between the chamber 94 and the point 98 in each air duct 50, 52, the total cross-sectional area of the ducting (ie. the combined cross-sectional area of the air ducts 50 and 52) remains substantially constant.

Figure 8:
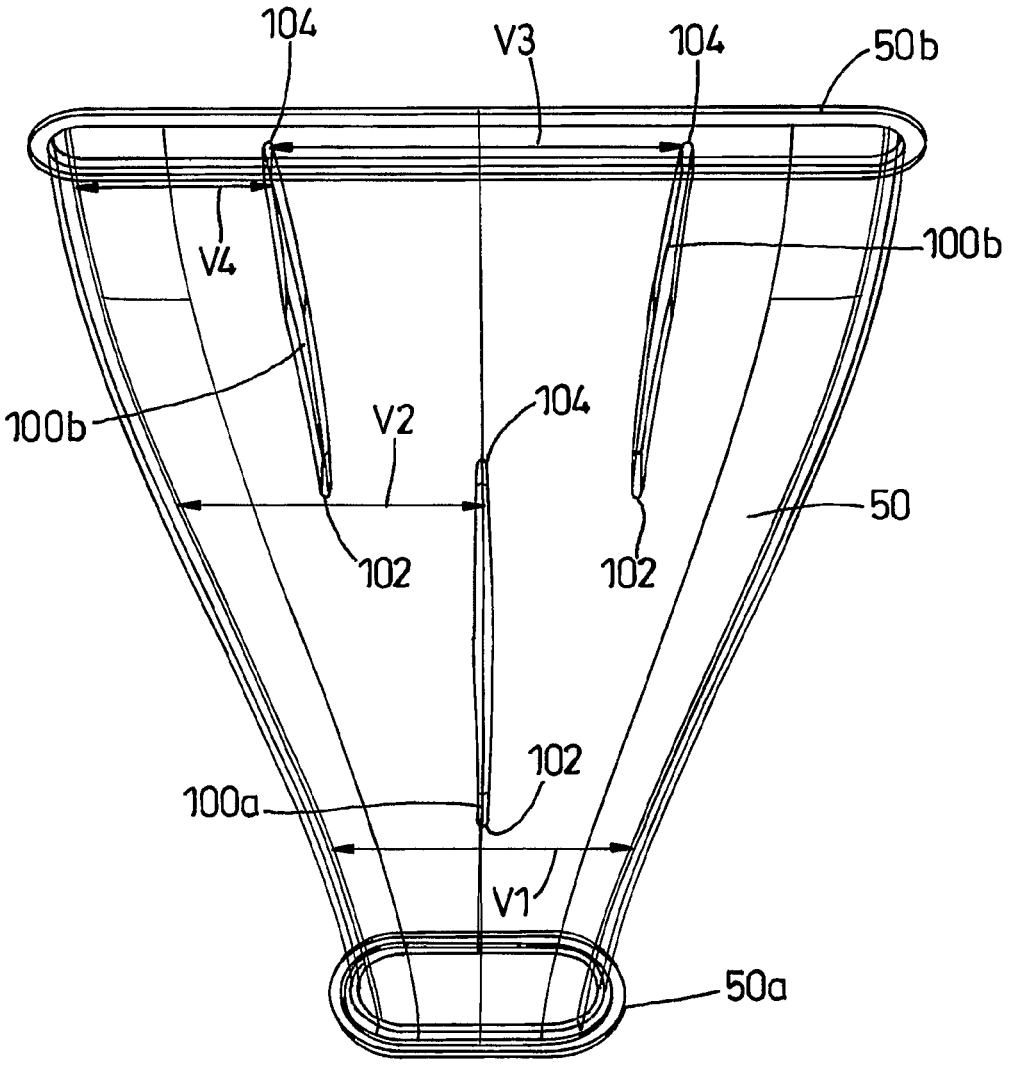
FIG. 8 is a sectional view of one of the air ducts of FIG. 7 showing the location of a plurality of vanes.

FIG. 8 shows the air duct 50 in section, the section being taken along the centre-line of the duct 50 itself. As can be seen, the lower end 50*a* of the duct 50 has a generally elongate cross-section and is adapted to communicate with one of the branches of the Y-junction 96. The upper end 50*b* of the air duct 50 communicates with the point 98 which is immediately upstream of the slot-like opening 60. The air duct 50 broadens as it approaches the upper end 50*b*.

Inside the air duct 50, three vanes 100 are provided. The vanes 100 have an elongate shape and lie so as to extend in the direction of the airflow passing along the air duct 50. To this end, the single upstream vane 100*a* is positioned so as to lie along the central axis of the duct 50 but the downstream vanes 100*b* are inclined slightly towards the side walls of the duct 50 so as to follow the steamlines of the airflow passing along the duct 50. Each vane 100 has an upstream edge 102 and a downstream edge 104, and each edge 102, 104 is radiussed so as to minimise any turbulence created in the airflow by virtue of their presence.

The position of the vanes 100*a*, 100*b* within the duct 50 is determined so that the distance between any one vane 100*a*, 100*b* and either the wall of the air duct 50 or an adjacent vane 100*b* is no more than half of the wavelength of the noise emitted by the motor. This is determined according to the operating speed of the motor and the velocity of sound within the airflow travelling along the air duct 50. It will be appreciated that this distance can be calculated according to the formula:

$$\text{Predetermined Value} = \frac{30 \times \text{Speed of sound in air duct}}{\text{Operating speed of the motor}}$$

It will also be appreciated that the speed of sound in the airflow will vary according to the temperature and pressure of the airflow. To simplify the calculation, it has been found effective to use in this equation the speed of sound in the airflow at the slot-like openings, which is the point at which the temperature is likely to be lowest. Under normal operating conditions of the hand dryer shown in the embodiment, we expect the airflow temperature at the slot-like openings to be approximately 55° C.—at which temperature the speed of sound in air is approximately 360 m/s. The predetermined value can them be calculated using the simplified formula:

$$\text{Predetermined Value} = \frac{10800}{\text{Operating speed of the motor}}$$

In the embodiment, the motor is designed to operate at a speed of approximately 90,000 rpm. The predetermined value is then calculated to be 120 mm. Other speeds of the motor result in the predetermined value being selected to be between 100 mm and 150 mm.

Having calculated the predetermined value, the vanes 100*a*, 100*b* are positioned in the air duct 50 so that all relevant distances are no more than this value—and can be considerably less. The distances V1-V4 which are to be no greater than the predetermined value are shown in FIG. 8.

As the breadth of the air duct 50 increases, the need to provide larger numbers of vanes also increases. The vanes 100 are thus arranged in rows with a single vane 100*a* provided in the first, upstream row and two vanes 100*b* provided in the next row. If the breadth of the air duct 50 had been sufficiently large in the downstream area, or if the predetermined value had been smaller so that only two vanes 100*b* were insufficient, three vanes 100*b* could easily have been provided.

The rows of vanes 100 are located so that the upstream edges 102 of the vanes 100*b* overlap with the downstream edge 104 of the vane 100*a*. This ensures that no point of the air duct 50 is left unrestricted in terms of the distance between the vanes 100 and the walls of the duct 50.

It will be appreciated that vanes 100 are provided in the air duct 52 in the same manner as those provided in the air duct 50, with the predetermined value being calculated in the same way.

The hand dryer 10 described above operates in the following manner. When a user's hands are first inserted into the cavity 30 through the cavity entrance 32, the sensors 64 detect the presence of the user's hands and send a signal to the motor to drive the fan 40. The fan 40 is thus activated and air is drawn into the hand dryer 10 via the air inlet 44 at a rate of approximately 20 to 40 litres per second and preferably at a rate of least 25 to 27 litres per second, more preferably air is drawn into the hand dryer 10 at a rate of 31 to 35 litres per second. The air passes through the filter 46 and along the fan inlet 42 to the fan 40. The airflow leaving the fan 40 is divided into two separate airflows; one passing along the front air duct 50 to the slot-like opening 60 and the other passing along the rear air duct 52 to the slot-like opening 62.

As the airflow passes along the air ducts 50, 52, it divides into a plurality of airflow portions and flows past the vanes 100 located in each air duct 50, 52. The noise emitted by the motor is attenuated by the fact that the distance between the vanes 100 and the walls of the ducts 50, 52, and between the vanes 100 themselves, is restricted to a value which does not exceed the half-wavelength of the sound waves of the noise.

The airflow is ejected from the slot-like openings 60, 62 in the form of very thin, stratified sheets of high velocity, high pressure air. As the airflows leave the slot-like openings 60, 62, the air pressure is at least 15 kPa and preferably approximately 20 to 23 kPa. Furthermore, the speed of the airflow leaving the slot-like openings 60, 62 is at least 80 m/s and preferably at least 100 or 150 m/s, more preferably approximately 180 m/s. Because the size of the slot-like opening 62 located at the end of the rear duct 52 is greater than the size of the slot-like opening 60 located at the end of the front duct 50, a larger volume of air is emitted from the duct 52 than from the duct 50. This provides a greater mass of air for drying the backs of the user's hands which is advantageous.

The two thin sheets of stratified, high velocity, high pressure air are directed towards the surfaces of the user's hands which, during use, are inserted fully into the cavity 30 and are subsequently withdrawn from the cavity 30 via the cavity entrance 32. As the user's hands pass into and out of the cavity 30, the sheets of air blow any existing water off the user's hands. This is achieved reliably and effectively because of the high momentum of the air leaving the slot-like openings 60, 62 and because the airflow is evenly distributed along the length of each slot-like opening 60, 62.

Each stratified sheet of air is directed towards the wall of the cavity 30 which is remote from the slot-like opening through which the respective sheet of air is emitted. Because the slot-like openings 60, 62 are also inclined towards the lowermost end of the cavity 30, the emitted airflows are directed into the cavity 30. This reduces the risk of turbulent air movement being felt by the user outside the casing, e.g. in the user's face.

It is envisaged that it will take only a small number of "passes" of the hand dryer described above to dry a user's hands to a satisfactory degree. (By "pass", we mean a single insertion of the hands into the cavity and subsequent removal therefrom at a speed which is not unacceptable to an average user. We envisage that a single pass will have a duration of no more than 3 seconds.) The momentum achieved by the airflows is sufficient to remove the majority of water found on the surface of the user's hands after washing during a single pass.

The water removed by the airflows is collected inside the cavity 30. Each airflow will rapidly lose its momentum once it has passed the user's hands and the water droplets will fall to the lower end of the cavity 30 under the forces of gravity whilst the air exits the cavity 30 either through the cavity entrance 32 or via the open sides of the cavity 30. The water, however, is collected by the drain 38 and passed to a reservoir (not shown) where it is collected for disposal. The reservoir can be emptied manually if desired. Alternatively, the hand dryer 10 can incorporate some form of water dispersal system including, for example, a heater for evaporating the collected water into the atmosphere. The means by which the collected water is dispersed does not form part of the present invention.

In an alternative embodiment, the slot-like openings 60*a*, 62*a* can be arranged so that the sheets of air which are emitted therefrom are directed generally along planes which are substantially parallel to one another. This minimises the amount of turbulent flow present inside the cavity 30 whilst the drying apparatus is in use.

The invention is not intended to be limited to the precise detail of the embodiment described above. Modifications and variations to the detail which do not alter the scope of the invention will be apparent to a skilled reader. For example, the shape of the cavity 30 and its entrance 32 may be altered without departing from the essence of the present invention. Also, the operational speed of the motor is not limited to the value given above but can be selected to provide the most suitable flowrate of air within the dryer.

The invention claimed is:

1. A drying apparatus, comprising a casing, a cavity formed in the casing for receiving an object, a fan located in the casing and creating an airflow, a motor provided in the casing for driving the fan and ducting for carrying the airflow from the fan to at least one opening arranged to emit the airflow into the cavity, wherein the ducting comprises at least one air duct along which the airflow from the fan passes to the opening and at least one vane located inside the air duct, the vane extending in the direction of the airflow and dividing the air duct and the airflow into a plurality of airflow portions.

2. The drying apparatus as claimed in claim 1, wherein the vane is positioned in the air duct such that the distance between the vane and any adjacent wall of the air duct or further vane is no more than a predetermined value.

3. The drying apparatus as claimed in claim 2, wherein the predetermined value is calculated as a function of the operating speed of the motor.

4. The drying apparatus as claimed in claim 2 or 3, wherein the predetermined value is calculated as a function of the speed of sound in the airflow passing along the air duct at the normal operating temperature.

5. The drying apparatus as claimed in claim 2 or 3, wherein the predetermined value is calculated according to the formula:

$$\text{Predetermined Value} = \frac{30 \times \text{Speed of sound in air duct}}{\text{Operating speed of the motor}}.$$

6. The drying apparatus as claimed in claim 5, wherein the predetermined value is calculated according to the formula:

$$\text{Predetermined Value} = \frac{10800}{\text{Operating speed of the motor}}.$$

7. The drying apparatus as claimed in claim 2 or 3, wherein the predetermined value is in the range from 100 mm to 150 mm.

8. The drying apparatus as claimed in claim 7, wherein the predetermined value is substantially 120 mm.

9. The drying apparatus as claimed in claim 2 or 3, wherein more than one vane is provided in the air duct.

10. The drying apparatus as claimed in claim 9, wherein the vanes are arranged in a plurality of rows.

11. The drying apparatus as claimed in claim 10, wherein adjacent rows of vanes overlap in the direction of the airflow.

12. The drying apparatus as claimed in claim 10, wherein the number of vanes in each row is higher than the number of vanes in a preceding row.

13. The drying apparatus as claimed in claim 2 or 3, wherein the breadth of the air duct increases between the fan and the opening.

14. The drying apparatus as claimed in claim 2 or 3, wherein the opening is a slot-like opening extending across the width of the cavity.

15. The drying apparatus as claimed in claim 14, wherein the width of the slot-like opening is no more than 0.8 mm.

16. The drying apparatus as claimed in claim 14, wherein the fan is adapted to cause an airflow to be emitted through the slot-like opening at a velocity of at least 100 m/s.

17. The drying apparatus as claimed in claim 16, wherein the fan is adapted to cause an airflow to be emitted through the slot-like opening at a pressure of at least 12 kPa.

18. The drying apparatus as claimed in claim 2 or 3, wherein the drying apparatus is a hand dryer.

19. The drying apparatus as claimed in claim 4, wherein the predetermined value is calculated according to the formula:

$$\text{Predetermined Value} = \frac{30 \times \text{Speed of sound in air duct}}{\text{Operating speed of the motor}}.$$

20. The drying apparatus as claimed in claim 19, wherein the predetermined value is calculated according to the formula:

$$\text{Predetermined Value} = \frac{10800}{\text{Operating speed of the motor}}.$$

* * * * *